US010813414B2

(12) United States Patent
Yokoi et al.

(10) Patent No.: US 10,813,414 B2
(45) Date of Patent: Oct. 27, 2020

(54) BUCKLE DEVICE

(71) Applicant: KABUSHIKI KAISHA TOKAI-RIKA-DENKI-SEISAKUSHO, Aichi-ken (JP)

(72) Inventors: Tomoya Yokoi, Aichi-ken (JP); Tomotaka Suzuki, Aichi-ken (JP); Takahiro Osaki, Aichi-ken (JP); Akihito Kunisada, Aichi-ken (JP); Kentaro Yamada, Aichi-ken (JP)

(73) Assignee: KABUSHIKI KAISHA TOKAI-RIKA-DENKI-SEISAKUSHO, Aichi (JP)

( * ) Notice: Subject to any disclaimer, the term of this patent is extended or adjusted under 35 U.S.C. 154(b) by 73 days.

(21) Appl. No.: 16/176,498

(22) Filed: Oct. 31, 2018

(65) Prior Publication Data

US 2019/0125036 A1 May 2, 2019

(30) Foreign Application Priority Data

Nov. 2, 2017 (JP) ..... 2017-212408

(51) Int. Cl.
*A44B 11/25* (2006.01)

(52) U.S. Cl.
CPC ..... *A44B 11/2569* (2013.01); *A44B 11/2507* (2013.01); *A44B 11/2523* (2013.01)

(58) Field of Classification Search
CPC ..... A44B 11/2569; A44B 11/2507; A44B 11/2523; A44B 11/2542
See application file for complete search history.

(56) References Cited

U.S. PATENT DOCUMENTS 9,015,913 B2 * 4/2015 Muromachi ..... A44B 11/2523 24/633
2008/0035465 A1 * 2/2008 Muromachi ..... A44B 11/2515 200/573

FOREIGN PATENT DOCUMENTS

JP 2011-115559 A 6/2011

* cited by examiner

*Primary Examiner* — Jack W Lavinder
(74) *Attorney, Agent, or Firm* — Roberts Calderon Safran & Cole P.C.

(57) ABSTRACT

In a cover of a buckle device, an engagement hook of a side wall of an upper cover is fit together with an engagement groove of a side wall of a lower cover to assemble the upper cover to the lower cover. When the side wall of the upper cover receives an external force, a holder of a buckle switch is sandwiched between a side plate of a buckle body and a rib of the lower cover such that the side plate receives the external force. Accordingly, the rigidity at the engagement hook of the cover is able to be increased.

5 Claims, 6 Drawing Sheets

SF
LH
UP
20
20C
20B
20A
14
24
38B
38A
42
44A
44B
44
44B
44D
44C
40B
40
40A
34B
34B
32B
30
34A
34C
34
34C
34
32
46A
46C
46
46D
46B
48A
48
52
50B
50
50A
16B
16A
16
18
10
54
56
58
60
62
22C
22B
22A
26B
26
26A
26B
74
36
22C
70
22
70A
22D
74
68
28C
28
28B
28A
28C

BUCKLE DEVICE

CROSS-REFERENCE TO RELATED APPLICATION

This application claims priority under 35 USC 119 from Japanese Patent Application No. 2017-212408 filed Nov. 2, 2017, the disclosure of which is incorporated by reference herein.

BACKGROUND

Field of the Invention

The present disclosure relates to a buckle device that engages with a tongue of a seatbelt device.

Related Art

In the buckle device described in Japanese Patent Application Laid-Open (JP-A) No. 2011-115559, a lower cover is provided with an anchor hook, and the anchor hook is engaged with the inside of an upper cover such that the lower cover is attached to the upper cover.

In this buckle device, it is desirable to have a configuration in which the lower cover does not come away from the upper cover even if the upper cover flexes and flexure occurs in the anchor hook of the lower cover.

SUMMARY

In consideration of the above circumstances, a buckle device is provided in which the rigidity at an engagement portion of a covering body is able to be increased.

A buckle device of a first aspect includes: a covering body into which a tongue provided at a belt is configured to be inserted, the covering body being provided with an engagement portion at which a first covering member and a second covering member are engaged; a rigid member that is provided inside the covering body, the belt being fitted on an occupant by the tongue, inserted into the covering body, being inserted into the rigid member; a detection unit that is provided inside the covering body, a moving section being moved at a communicating member (supporting member) in accordance with the tongue being inserted into the rigid member, whereby the detection unit detects insertion of the tongue into the rigid member; and a housing body in which the communicating member is housed, the housing body restraining movement of the engagement portion toward the rigid member due to the housing body being interposed between the engagement portion and the rigid member.

A buckle device of a second aspect is the buckle device of the first aspect, further including a restricting portion that is provided inside the covering body, the restricting portion restricting movement of the housing body in an insertion direction of the tongue by the restricting portion abutting the housing body.

A buckle device of a third aspect is the buckle device of the first or the second aspect, further including a closing portion that is provided at the engagement portion at a housing body side thereof, the closing portion closing a portion between the housing body and the engagement portion by the closing portion being abutted by an end portion of the housing body on an opposite side of the housing body from the communicating member.

In the buckle device of the first aspect, the first covering member and the second covering member of the covering body are engaged at the engagement portion of the covering body, the rigid member is provided inside the covering body, and the belt is fitted over an occupant by the tongue of the belt inserted into the covering body being inserted into the rigid member. The detection unit is provided inside the covering body, and in the detection unit, insertion of the tongue into the rigid member is detected as a result of the moving member being moved over the communicating member in accordance with insertion of the tongue into the rigid member. The communicating member is housed inside the housing body.

Movement of the engagement portion toward the rigid member is restricted by the housing body due to the housing body being interposed (sandwiched) between the engagement portion and the rigid member. Accordingly, the rigidity at the engagement portion of the housing body is able to be increased.

In the buckle device of the second aspect, the restricting portion inside the covering body restricts movement of the housing body in the insertion direction of the tongue by the restricting portion abutting the housing body. Accordingly, movement of the communicating member in the insertion direction of the tongue is able to be restricted.

In the buckle device of the third aspect, the closing portion is provided on the housing body side of the engagement portion. The closing portion closes the portion between the housing body and the engagement portion by the closing portion being abutted by the end portion of the housing body on the opposite side of the housing body from the communicating member. Accordingly, the entrance of foreign matter or the like to between the housing body and the engagement portion is able to be suppressed.

BRIEF DESCRIPTION OF THE DRAWINGS

An exemplary embodiment will be described in detail with reference to the following figures, wherein.

DETAILED DESCRIPTION

Detailed explanation follows regarding an exemplary embodiment, with reference to the drawings.

Figure 1:
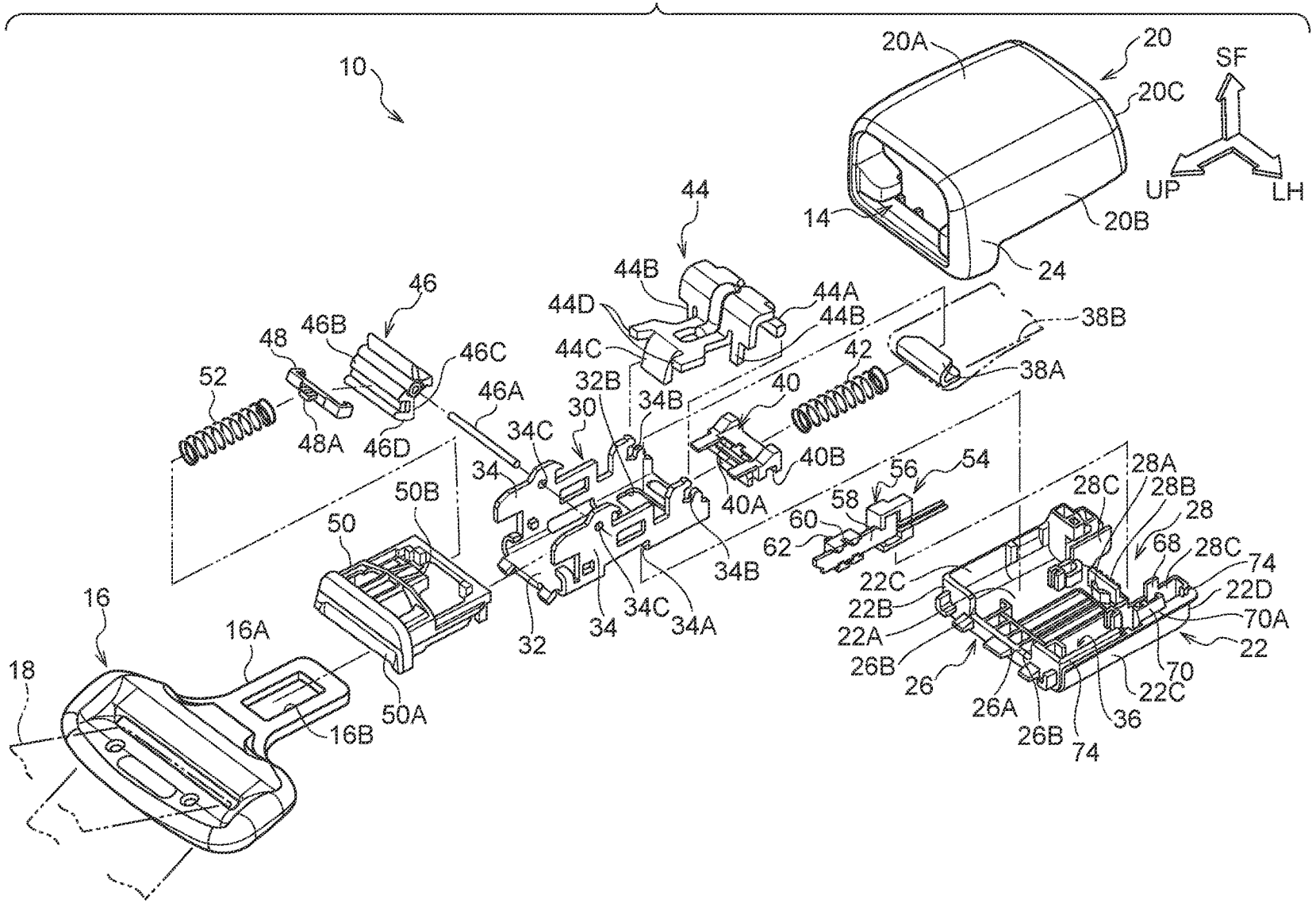
FIG. 1 is an exploded perspective view of relevant parts of a buckle device according to an exemplary embodiment.
Figure 2:
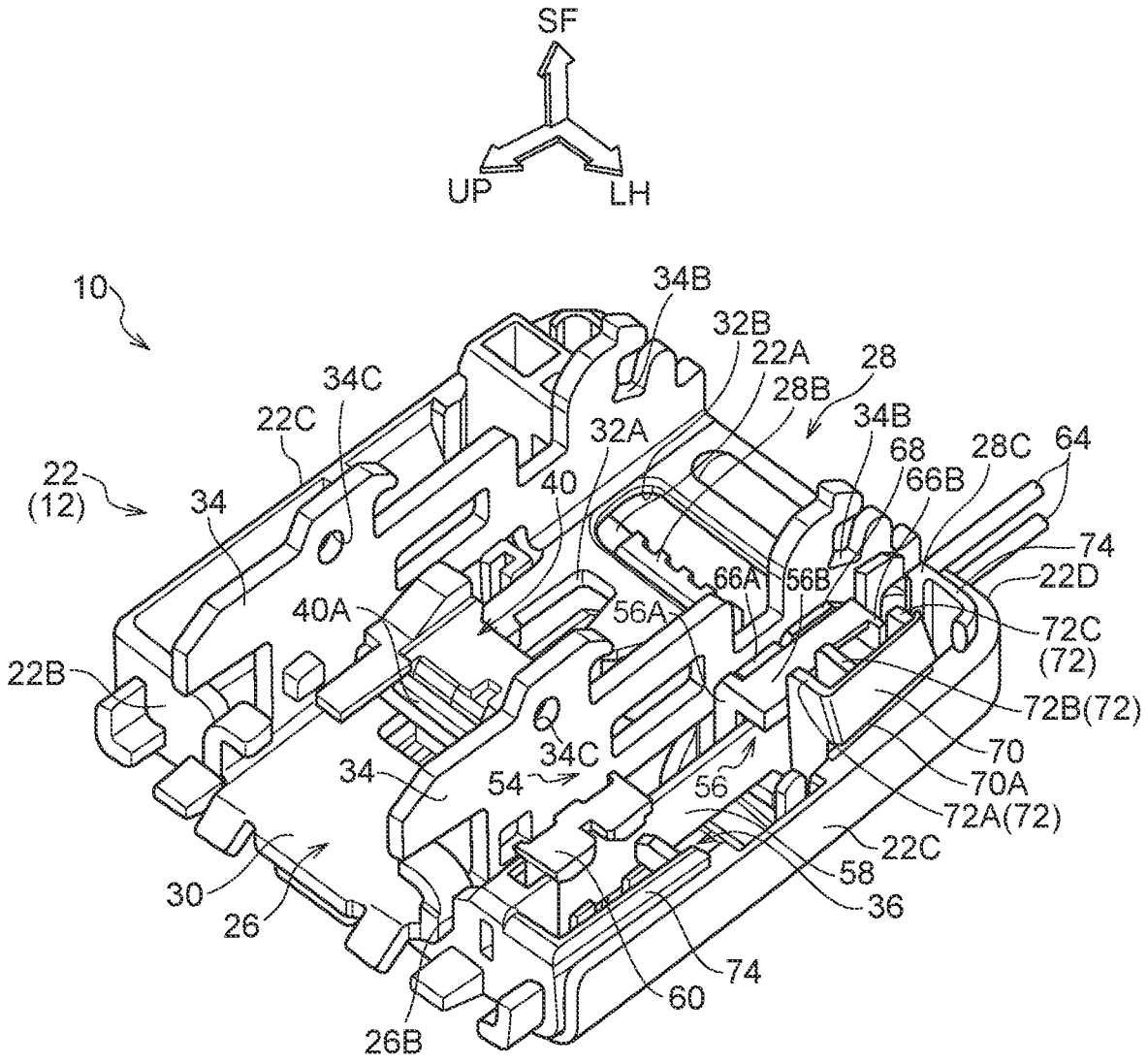
FIG. 2 is a perspective view illustrating relevant parts of a buckle device.
Figure 3:
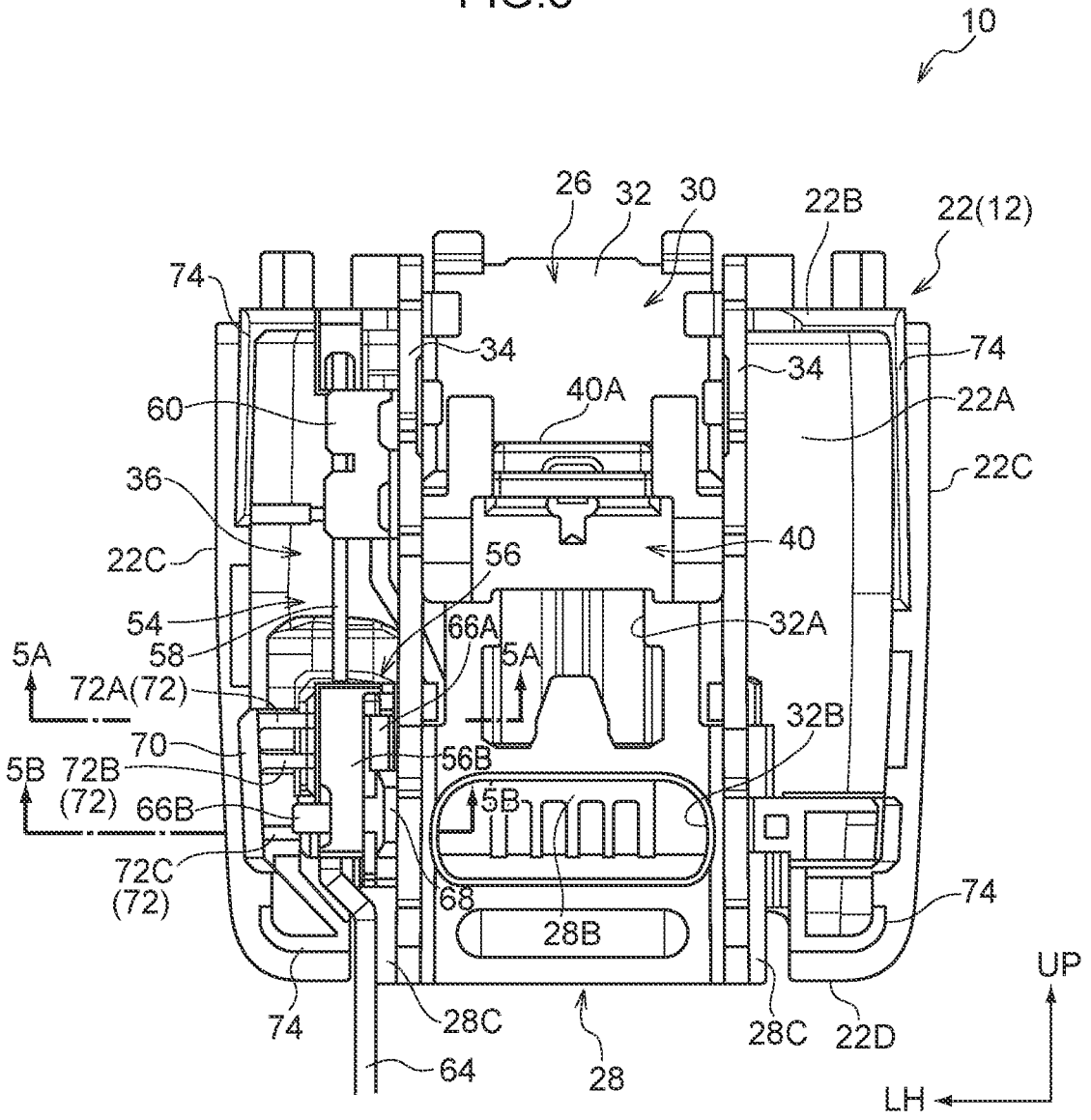
FIG. 3 is a plan view illustrating relevant parts of a buckle device.
Figure 4:
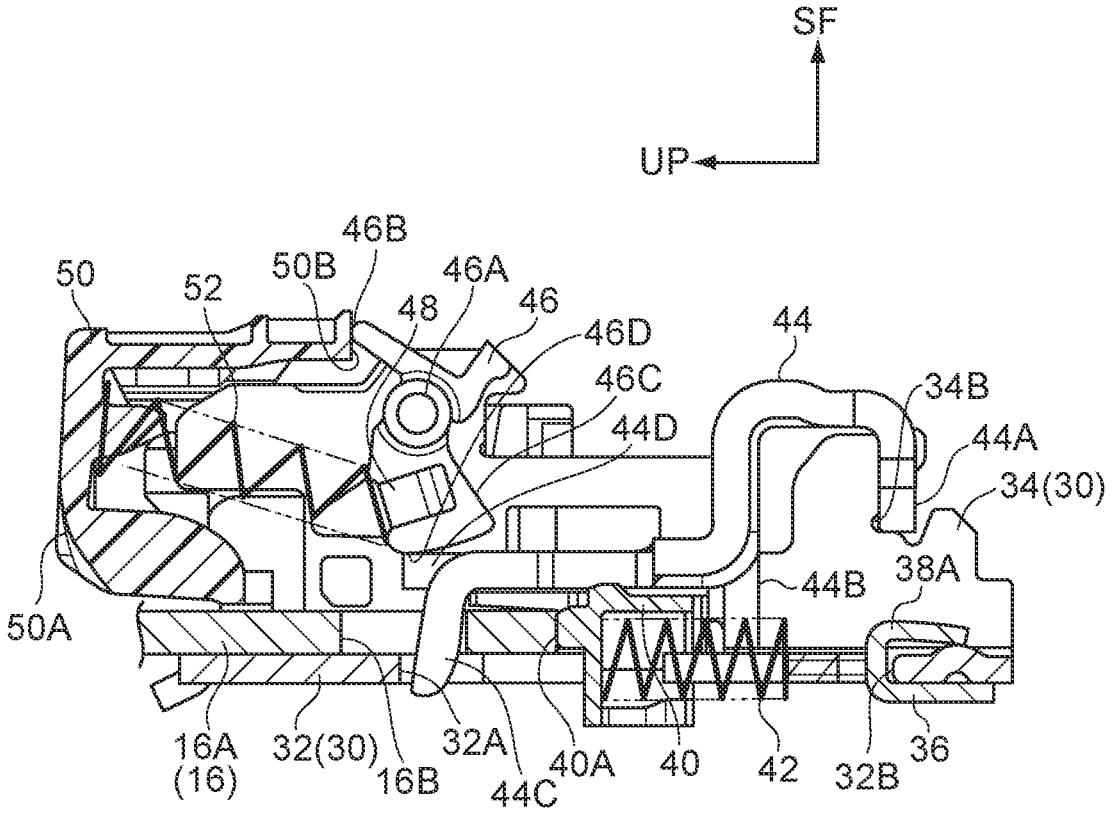
FIG. 4 is a left-view cross-section illustrating relevant parts of a buckle device.

FIG. 1 is an exploded perspective view illustrating a buckle device 10 according to the present exemplary embodiment, as seen obliquely from the obverse-left. FIG. 2 is a perspective view illustrating relevant parts of the buckle device 10, as seen obliquely from the obverse-left. FIG. 3 is a plan view illustrating relevant parts of the buckle device 10, as seen from the obverse side. FIG. 4 is a left-view cross-section illustrating relevant parts of the buckle device 10. Note that in the drawings, the upper side of the buckle device 10 is indicated by the arrow UP, the obverse (surface) side (one thickness direction side) of the buckle device 10 is indicated by the arrow SF, and the left side of the buckle device 10 is indicated by the arrow LH.

The buckle device 10 according to the present exemplary embodiment is mounted at the lower side and vehicle width direction inner side of a vehicle seat (at a side of the seat), so as to be disposed at the lower side and left side (or right side) of an occupant seated in the seat (or may be mounted in a rear seat so as to be disposed at the side of a sitting position). The upper side of the buckle device 10 is oriented toward a seat upper side, the left side of the buckle device 10 is oriented toward a vehicle front side or vehicle rear side, and a reverse side (another thickness direction side) of the buckle device 10 is oriented toward the seat (toward the occupant).

As illustrated in FIG. 1, the buckle device 10 is provided with a substantially rectangular-case-shaped cover 12. The cover 12 is made of resin and serves as a covering body. The inside of the cover 12 is open toward the upper side and the lower side. A tongue insertion slot 14 is formed in an upper end of the cover 12. A tongue plate 16, serving as a tongue, is able to be inserted into the tongue insertion slot 14 from the upper side. A rectangular-plate-shaped insertion part 16A is provided at a leading end portion of the tongue plate 16, and a rectangular engagement hole 16B is formed through the insertion part 16A. The tongue plate 16 is such that the insertion part 16A can be inserted into (set into or fitted into) the tongue insertion slot 14. An elongated-strip-shaped webbing 18 for occupant restraint, serving as a belt, passes through a base end portion of the tongue plate 16 so as to be capable of movement. The webbing 18 is mounted in the vehicle in a state taken up on a take-up device (not shown in the drawings).

The cover 12 is structured by assembling together an upper cover 20 and a lower cover 22, which respectively serve as a first covering member and a second covering member. The upper cover 20 structures an upper end portion of the cover 12 and an obverse side section of the cover 12 other than the upper end portion of the cover 12. The lower cover 22 structures a reverse side section of the cover 12 other than the upper end portion of the cover 12.

The upper cover 20 has a substantially cuboidal (rectangular parallelepiped) case shape. A substantially flat-plate-shaped obverse plate 20A is provided to the upper cover 20 substantially perpendicularly to an obverse-reverse direction. A side wall 20B is formed at each left-right direction side of the obverse plate 20A. A lower wall 20C is formed at the lower side of the obverse plate 20A. The side walls 20B and the lower wall 20C extend toward the reverse side (lower cover 22 side). A substantially rectangular-frame-shaped frame 24 is provided to the upper cover 20. The tongue insertion slot 14 is formed through the frame 24. In the upper cover 20, upper ends of the obverse plate 20A and the side wall 20B are connected to the frame 24. The frame 24 projects toward the reverse side than a leading end (reverse side end) of the side walls 20B. The inside of the upper cover 20 is thus open toward the upper side (tongue insertion slot 14 side) and the reverse side (lower cover 22 side).

As illustrated in FIGS. 1 to 3, the lower cover 22 has a substantially cuboidal (rectangular parallelepiped) case shape. A substantially flat-plate-shaped bottom plate 22A is provided to the lower cover 22 substantially perpendicularly to the obverse-reverse direction. An upper wall 22B is formed to an upper end portion of the bottom plate 22A. A side wall 22C is formed to each left-right direction end portion of the bottom plate 22A. A lower wall 22D is formed to a lower portion of the bottom plate 22A. The inside of the lower cover 22 is thus open toward the obverse side (upper cover 20 side).

The cover 12 is assembled by placing leading ends of the side walls 20B and the lower wall 20C of the upper cover 20 against leading ends of the side walls 22C and the lower wall 22D of the lower cover 22, and engaging the upper wall 22B of the lower cover 22 to the lower side of the frame 24.

A rectangular disposition hole 26 is formed through a left-right direction intermediate section of the upper wall 22B of the lower cover 22. The disposition hole 26 is bounded by a bottom edge 26A on the bottom plate 22A side, and a side edge 26B on each left-right direction side of the bottom edge 26A. The disposition hole 26 is open toward the upper side and the obverse side. A lead-out hole 28 is formed in a left-right direction intermediate section of the lower wall 22D of the lower cover 22. A rectangular support wall 28A is formed at the lower side of an obverse side face of the bottom plate 22A, and a restricting wall 28B is formed at the lower side of the rectangular support wall 28A. The rectangular support wall 28A and the restricting wall 28B extend out toward the obverse side, and the restricting wall 28B is taller than the rectangular support wall 28A. A side plate 28C is formed at each left-right direction side of the restricting wall 28B. The side plates 28C extend from the bottom plate 22A and the lower wall 22D. Thus, the lead-out hole 28 is open toward the lower side and the obverse side between the side plates 28C, and a lower portion inside the lower cover 22 is open toward the lower side and the obverse side between the restricting wall 28B and the side plates 28C.

In the lower cover 22, the bottom edge 26A of the disposition hole 26 and an obverse side end face of the support wall 28A of the lead-out hole 28 are so as to be flush (coplanar), and the spacing between the side edges 26B of the disposition hole 26 and the spacing between opposing (facing) faces of the side plates 28C of the lead-out hole 28 are so as to be similar to one other.

A buckle body 30 that is made of metal and has a substantially U-shaped profile (cross-sectional view), serving as a rigid member, is disposed inside the cover 12. The buckle body 30 is provided with an elongated-flat-plate-shaped bottom plate 32. An elongated-flat-plate-shaped side plate 34 is provided to a left side section and a right side section of the bottom plate 32. Each side plate 34 stands up from the bottom plate 32 perpendicularly to the left-right direction. An insertion hole 32A (see FIGS. 2 and 3) is formed through the bottom plate 32 of the buckle body 30. The insertion hole 32A is elongated in the up-down direction. An attachment hole 32B is formed through a lower side section of the bottom plate 32. The attachment hole 32B is elongated in the left-right direction.

In the buckle body 30, the bottom plate 32 makes surface contact with the bottom edge 26A on the disposition hole 26 side of the lower cover 22 and with the obverse side end face of the rectangular support wall 28A on the lead-out hole 28 side of the lower cover 22, and is disposed perpendicularly to the obverse-reverse direction. The side plates 34 make surface contact with the side edges 26B on the disposition hole 26 side of the lower cover 22 and with the side plates 28C on the lead-out hole 28 side of the lower cover 22.

The buckle body 30 thus fits into the disposition hole 26 and the lead-out hole 28 and attaches to the lower cover 22. The inside of the buckle body 30 is open toward the obverse side (upper cover 20 side), the upper side, and the lower side, and is in communication with the tongue insertion slot 14 of the cover 12. The insertion part 16A of the tongue plate 16 is inserted into the buckle body 30 from the upper side (through the tongue insertion slot 14). The restricting wall 28B of the lower cover 22 is inserted into the attachment hole 32B in the buckle body 30, and an upper side face of the restricting wall 28B abuts an upper side peripheral edge portion of the attachment hole 32B.

A disposition space 36 is formed between the side plate 34 of the buckle body 30 and the side wall 22C of the lower cover 22 in the left side section inside the lower cover 22. A through-hole 34A is formed through a boundary section between the bottom plate 32 of the buckle body 30 and the side plate 34 on the left side of the buckle body 30. The through-hole 34A is elongated in the up-down direction. The through-hole 34A places the inside of the buckle body 30 in communication with the inside of the disposition space 36.

As illustrated in FIGS. 1 and 4, a protector 38A that has a substantially U-shaped profile (cross-sectional view) is fit into a lower side edge portion of the attachment hole 32B of the bottom plate 32. Webbing 38B (see FIG. 1), serving as an attachment member, is inserted into the cover 12 through the lead-out hole 28. A leading end side of the webbing 38B is inserted into the attachment hole 32B of the buckle body 30, and is entrained around the protector 38A. The leading end side of the webbing 38B overlaps with base end side webbing 38B, and fastened by a fastening member such as a rivet. A base end portion of the webbing 38B is fastened and fixed to the vehicle body or the seat, and the buckle device 10 is mounted to the vehicle by the webbing 38B leading out from the lead-out hole 28 of the cover 12.

As illustrated in FIG. 1, a substantially plate-shaped ejector 40 made of resin, serving as a moving member, is inserted and disposed inside the buckle body 30. The ejector 40 fits between the pair of side plates 34 of the buckle body 30. A reverse side (lower cover 22 side) section of the ejector 40 engages with the insertion hole 32A in the bottom plate 32 of the buckle body 30 so as to be capable of sliding in the up-down direction with respect to the bottom plate 32 over a predetermined range. The ejector 40 is able to be disposed in a ejected position and an inserted position (see FIG. 4).

At the lower side of the ejector 40, an ejector spring 42, serving as an urging member, is disposed spanning between the ejector 40 and a lower end of the insertion hole 32A in the buckle body 30. The ejector spring 42 is a compression coil spring. The ejector spring 42 urges the ejector 40 upward so as to dispose the ejector 40 in the ejected position. A press face 40A is formed at an upper face of an obverse side (upper cover 20 side) section of the ejector 40. When the insertion part 16A of the tongue plate 16 is inserted into the buckle body 30 from the upper side, the press face 40A is pressed downward by the insertion part 16A, and the ejector 40 slides downward against urging force from the ejector spring 42, such that the ejector 40 is disposed in the inserted position.

An engagement recess 40B that has a rectangular shape when viewed from the left is formed in a left end portion of the ejector 40. The engagement recess 40B is open toward the reverse side and the left. The engagement recess 40B opposes (faces) the through-hole 34A in the side plate 34 of the buckle body 30 over a range from the inserted position to the ejected position of the ejector 40.

As illustrated in FIGS. 1 to 4, a plate-shaped lock plate 44 made of metal, serving as an anchoring member, is disposed on the obverse side (upper cover 20 side) of the ejector 40 inside the cover 12. A lower side section of the lock plate 44 is curved so as to have a shape that protrudes toward the obverse side. A pair of supports 44A is formed at the reverse side of a lower side end of the lock plate 44. The supports 44A project toward the left-right direction outer sides. The supports 44A fit together with cutouts 34B in the side plates 34 of the buckle body 30, and are supported thereby so as to be capable of rotating. The lock plate 44 is thereby supported by the pair of side plates 34 so as to be capable of rotating over a predetermined angle about the pair of supports 44A.

A pair of arms 44B is formed to the lock plate 44 on the upper side (upper side end of the curved section) of the pair of supports 44A. The arms 44B extend out toward the reverse side (lower cover 22 side) from respective left-right direction ends of the lock plate 44. The arms 44B are inserted into the buckle body 30, and when the ejector 40 slides downward, the pair of arms 44B are pressed downward by the ejector 40 and the lock plate 44 is rotated toward the reverse side (engaged position side).

As illustrated in FIG. 1, an engagement piece 44C is formed at an upper end of the lock plate 44. The engagement piece 44C extends out in an upward direction on progression toward the reverse side. The engagement piece 44C interferes with an obverse side face of the ejector 40, thereby obstructing rotation of the lock plate 44 toward the reverse side, and retaining the lock plate 44 in a disengaged position. When the lock plate 44 rotates toward the reverse side and reaches an engaged position, the engagement piece 44C is inserted into the engagement hole 16B in the tongue plate 16 and the insertion hole 32A in the buckle body 30, whereby the tongue plate 16 is anchored against sliding upward (see FIG. 4).

Abutting pieces 44D are formed at the upper end of the lock plate 44. The abutting pieces 44D project toward the upper side from respective left-right direction outer sides of the engagement piece 44C.

A columnar lock member 46 (cam) is provided inside the cover 12 at the obverse side (upper cover 20 side) and the upper side of the lock plate 44. The lock member 46 is disposed running along the left-right direction. A circular-column-shaped shaft 46A projects from each left-right direction end of the lock member 46. The shaft 46A is inserted into support holes 34C in the side plates 34 of the buckle body 30, and is supported thereby so as to be capable of rotating. The lock member 46 is thus supported by the buckle body 30 so as to be capable of swinging about the shaft 46A.

A substantially plate-shaped pressed portion 46B is formed to an obverse side section of the lock member 46. The pressed portion 46B projects toward the obverse side. An abutting face 46C is a lower face of a reverse side (lower cover 22 side) section of the lock member 46. The abutting face 46C is abutted by an upper side face of the abutting pieces 44D of the lock plate 44, such that the lock member 46 is retained in an unlock position.

A lock face 46D is a reverse side face of the lock member 46. The lock face 46D is a circumferential face that is coaxial with the shaft 46A. When the lock plate 44 is disposed in the engaged position, the lock member 46 is retained in a lock position, and the lock face 46D abuts obverse side faces of the abutting pieces 44D of the lock plate 44 (see FIG. 4).

A substantially U-shaped frame-shaped holder 48 made of resin is attached, from the upper side, to a reverse side (lower cover 22 side) section of the lock member 46 at each left-right direction end of the lock member 46. A substantially rectangular-plate-shaped spring holder part 48A is formed at a left-right direction center of the holder 48. The spring holder part 48A projects toward the upper side.

A release button 50, serving as an insertion member, is provided at the upper side of the lock member 46. An upper face of the release button 50 is exposed from the upper end of the cover 12. A case-shaped operation portion 50A is provided at an upper side section of the release button 50. The operation portion 50A is able to be press-operated downward by an occupant. The inside of the operation portion 50A is open toward the lower side. The tongue insertion slot 14 at the upper end of the cover 12 is formed between the operation portion 50A and the lower cover 22.

A lower side section of the release button 50 engages with the pair of side plates 34 of the buckle body 30 so as to be capable of moving in the up-down direction. The release button 50 is supported by the buckle body 30 so as to be capable of moving in the up-down direction over a predetermined range.

A pressing portion 50B is formed to the release button 50 at the obverse side (upper cover 20 side) and the lower side of the operation portion 50A. The pressing portion 50B projects toward the lower side. The pressing portion 50B is disposed at the upper side of the pressed portion 46B of the lock member 46. When the release button 50 is press-operated downward, the pressed portion 46B is pressed downward by the pressing portion 50B, and the lock member 46 swings toward the unlock position about the shaft 46A.

A lock spring 52 is disposed spanning between an upper wall of the operation portion 50A of the release button 50 and the spring holder part 48A of the holder 48. The lock spring 52 is a compression coil spring, and the lock spring 52 urges the lock member 46 toward the lock position via the holder 48.

As illustrated in FIGS. 1 to 3, a sliding-contact type buckle switch 54, serving as a detection unit, is disposed inside the lower cover 22. The buckle switch 54 is attached to the inside of the disposition space 36 in the lower cover 22.

A substantially cuboidal (rectangular parallelepiped)-box-shaped holder (substrate base) 56, serving as a housing body, is provided to a lower portion of the buckle switch 54. The holder 56 is open toward the left side (side wall 22C side). A lower end portion of an elongated-rectangular-plate-shaped switch substrate 58 (stationary portion), serving as a communicating member (supporting member), is fixed to the inside of the holder 56. In the disposition space 36 (in the space between the side plate 34 of the buckle body 30 and the side wall 22C of the lower cover 22), the switch substrate 58 extends upward from the holder 56.

The switch substrate 58 is disposed perpendicularly to the left-right direction. Plural (three, in the present embodiment) electrically conductive patterns (not shown in the drawings), serving as conductor portions, are formed by thin metal film on a right side face (face on the side of the side plate 34 of the buckle body 30) of the switch substrate 58. The plural electrically conductive patterns on the switch substrate 58 are insulated from one another.

A substantially cuboidal (rectangular parallelepiped) slide member 60 (slider), serving as a moving section, is supported by the switch substrate 58. The slide member 60 is configured so as to be capable of sliding along the switch substrate 58 in the up-down direction (along the longitudinal direction of the switch substrate 58) on the right side of the switch substrate 58. The slide member 60 allows electrical continuity between the plural electrically conductive patterns (not shown in the drawings) on the switch substrate 58. The combination of electrically conductive patterns that has electrical continuity is changed in accordance with the slide position (up-down direction position) of the slide member 60.

A substantially rectangular-column-shaped boss 62 (engagement projection), serving as a coupling portion, is provided to a right side face of the slide member 60. The boss 62 projects rightward from the slide member 60. The boss 62 passes through the through-hole 34A in the buckle body 30 so as to be capable of sliding in the up-down direction, and is inserted into the engagement recess 40B in the ejector 40.

When the ejector 40 is disposed in the ejected position, the slide member 60 is disposed in an ejected position (a position corresponding to the ejected position of the ejector 40) at the upper side of the switch substrate 58. Further, when the insertion part 16A of the tongue plate 16 is inserted into the tongue insertion slot 14 at the upper end of the cover 12, the ejector 40 slides downward, and the boss 62 is pressed downward by the engagement recess 40B, whereby the slide member 60 slides downward and the slide member 60 is disposed in an inserted position (a position corresponding to the inserted position of the ejector 40).

When the slide member 60 is disposed in the ejected position, a first combination of the plural electrically conductive patterns is set to the combination of the plural electrically conductive patterns on the switch substrate 58 that are made electrical continuous to one another by the slide member 60. The buckle switch 54 accordingly detects that the insertion part 16A of the tongue plate 16 is not inserted into the tongue insertion slot 14 at the upper end of the cover 12. When the slide member 60 is disposed in the inserted position, a second combination of the plural electrically conductive patterns is set to the combination of the plural electrically conductive patterns on the switch substrate 58 the conductive patterns being made electrical continuous to one another by the slide member 60. The buckle switch 54 accordingly detects that the insertion part 16A of the tongue plate 16 has been inserted into the tongue insertion slot 14 at the upper end of the cover 12.

Figure 5A:
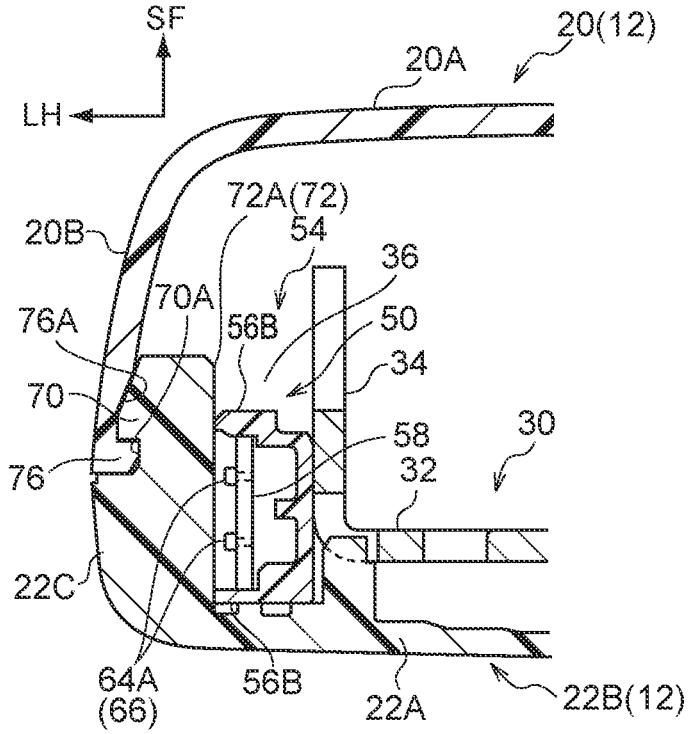
FIG. 5A is a schematic cross-sectional view along line 5A-5A in FIG. 3.
Figure 5B:
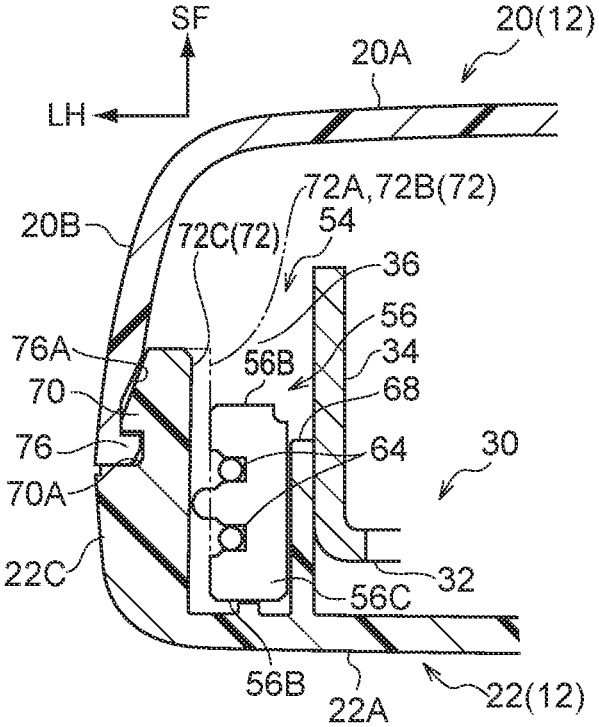
FIG. 5B is a schematic cross-sectional view along line 5B-5B in FIG. 3.
Figure 5C:
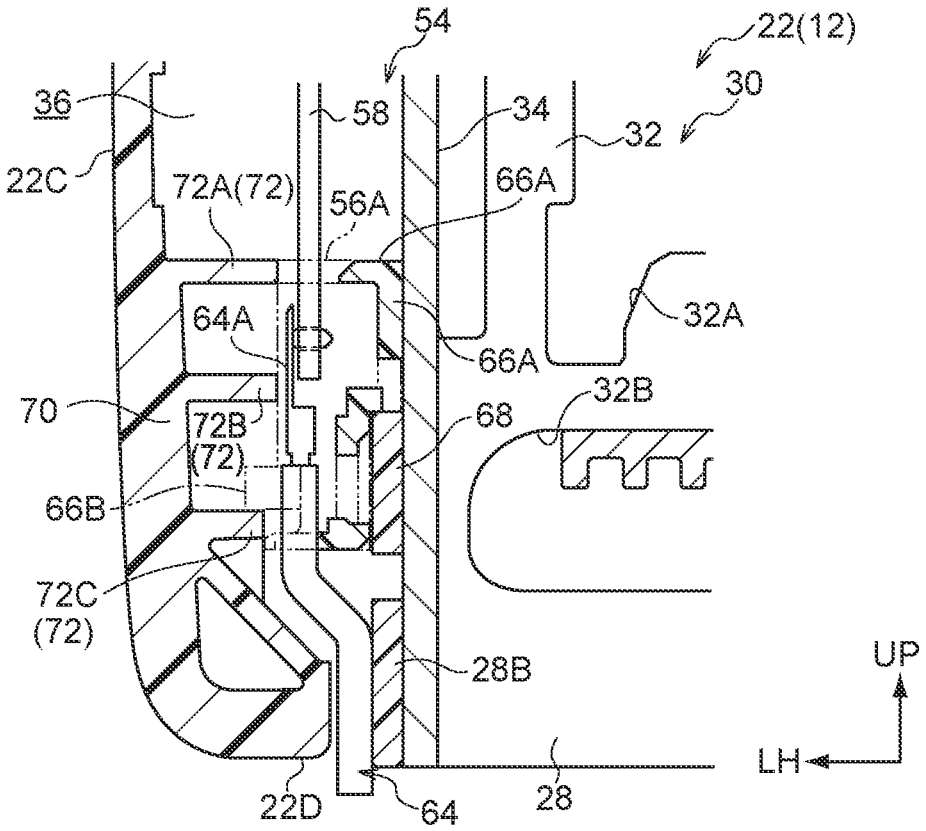
FIG. 5C is a schematic cross-sectional view of relevant parts of a buckle device, as seen from an obverse side.

As illustrated in FIGS. 1 to 4, the holder 56 of the buckle switch 54 is disposed in a lower side section of the disposition space 36. FIG. 5A is a schematic cross-sectional view illustrating relevant parts along line 5A-5A in FIG. 3. FIG. 5B is a schematic cross-sectional view illustrating relevant parts along line 5B-5B in FIG. 3. FIG. 5C is a schematic cross-sectional view illustrating relevant parts in an intermediate portion in the obverse-reverse direction.

As illustrated in FIGS. 1 to 3, 5A, and 5B, a peripheral portion of the holder 56 is structured by an upper plate 56A on the upper side, side plates 56B at the obverse side and the reverse side, and a lower plate 56C at the lower side, which surround the interior of the holder 56. The side plate 56B on the obverse side of the holder 56 is disposed further toward the obverse side than the obverse side end of the side wall 22C of the lower cover 22.

The lower end portion (base end portion) of the switch substrate 58 is fit into a rectangular notch formed in the upper plate 56A of the holder 56, is inserted into the holder 56 from the open side of the holder 56, and is nipped (held) between the side plates 56B of the holder 56 (see FIG. 5A). A leading end portion of a harness 64, serving as connection wiring, is disposed inside the holder 56. A base end portion side of the harness 64 leads out to the outside of the holder 56 through a notch formed in the lower plate 56C of the holder 56, and leads out to the outside of the cover 12 through the lower wall 22D of the lower cover 22. The base end portion of the harness 64 is electrically connected to a controller of the vehicle (not shown in the drawings).

As illustrated in FIG. 5C, a leading end of each wiring of the harness 64 is connected to a terminal 64A inside the holder 56. Inside the holder 56, a leading end portion of each terminal 64A passes through the switch substrate 58 from a left side face of the switch substrate 58 to a right side face of the switch substrate 58. The leading end portion of the terminals 64A are electrically connected and fixed to each of the electrically conductive patterns on the switch substrate 58 at the right side face of the switch substrate 58 using solder or the like. The electrically conductive patterns on the switch substrate 58 of the buckle switch 54 are thereby electrically connected to the controller of the vehicle. The controller of the vehicle detects whether or not the tongue plate 16 is inserted into the buckle device 10 based on the combination of electrically conductive patterns that have electrical continuity.

As illustrated in FIGS. 2 and 3, a cuboidal (rectangular parallelepiped) projecting portion 66A is integrally formed at an upper side of a right side face (face on the side of the side plate 34 of the buckle body 30) of the holder 56. The projecting portion 66A is in close proximity to (or it is possible that projecting portion 66A abuts) the side plate 34 of the buckle body 30 so as to be capable of surface contact therewith. A cuboidal (rectangular parallelepiped) protrusion 66B is formed at a lower side of a left side face (face on the side of the side wall 22C of the lower cover 22) of the holder 56. The protrusion 66B projects toward the left side.

A rectangular-plate-shaped restricting wall 68, structuring a restricting portion, is provided at the lower side of the obverse side face of the bottom plate 22A of the lower cover 22. The restricting wall 68 extends out toward the obverse side from the bottom plate 22A, and makes surface contact with the left side face of the side plate 34. Rightward movement of the holder 56 is thus restricted by the side plate 34 of the buckle body 30, and downward movement of the holder 56 is restricted by the restricting wall 68.

As illustrated in FIGS. 2, 3, 5A, and 5B, an engagement wall 70, structuring an engagement portion, is formed at the side wall 22C on the left side of the lower cover 22. The engagement wall 70 projects from an obverse side end face of the side wall 22C, at the left of the holder 56, and is inclined toward the left side on progression toward the obverse side. An engagement groove 70A that has a substantially rectangular profile (cross-sectional view) is formed in a base portion of the engagement wall 70. The engagement groove 70A extends along the up-down direction on the obverse side of the obverse side end face of the side wall 22C.

Plural ribs 72 (three ribs 72A, 72B, and 72C in the present embodiment) are formed on a right side face of the engagement wall 70, arranged in the up-down direction. The plural ribs 72A to 72C project toward the right side from the engagement wall 70 and extend and reach to the bottom plate 22A. Projecting leading end faces of the ribs 72A to 72C are substantially perpendicular to the left-right direction. The rib 72A on the upper side structures a closing portion. The rib 72A contacts (abuts) an upper side section of the holder 56 (or it is possible that the rib 72A is in close proximity the upper side section of the holder 56 so as to be capable of making contact therewith). The rib 72B, adjacent to of the rib 72A at the lower side of the rib 72A, contacts a lower side section of the projecting portion 66A of the holder 56 (or it is possible that the rib 72B is in close proximity to the lower side section of the projecting portion 66A of the holder 56 so as to be capable of making contact therewith). The rib 72C at the lower side structures a restricting portion. The rib 72C contacts a lower side section of the holder 56 (or it is possible that the rib 72C is in close proximity to the lower side section of the holder 56 so as to be capable of making contact therewith), and an upper side face of the rib 72C makes surface contact with a lower side face of the protrusion 66B of the holder 56.

As illustrated in FIGS. 1 to 3, protruding portions 74 that have a substantially rectangular profile (cross-sectional view) are formed at the lower wall 22D and at the side wall 22C on the left side of the lower cover 22, on the inner side portion of the obverse side end face thereof. The protruding portion 74 on the side wall 22C extends along the up-down direction, and the protruding portion 74 on the lower wall 22D extends along the left-right direction.

As illustrated in FIGS. 5A and 5B, an engagement hook (claw) 76 that has a substantially trapezoidal profile (cross-sectional view) and structures the engagement portion, is formed at the side wall 20B on the left side of the upper cover 20. The engagement hook 76 projects toward the right side (toward the inside of the upper cover 20) at a reverse side end portion of the side wall 20B on the left side. The engagement hook 76 extends along the up-down direction over a region opposing (facing) the engagement wall 70 (engagement groove 70A) of the lower cover 22.

An engagement recess 76A is formed in a right side face (inner face) of the side wall 20B on the left side of the upper cover 20. The engagement recess 76A is curved in a recessed shape so as to match the profile (cross-sectional) shape of the left side section of the engagement wall 70 of the lower cover 22, and extends in the up-down direction. Recesses (not shown in the drawings) are provided in reverse side end faces of the lower wall 20C and the side wall 20B on the left side of the upper cover 20.

When the upper cover 20 and the lower cover 22 are assembled together, the protruding portions 74 on the side wall 22C and the lower wall 22D of the lower cover 22 fit together with the recesses in the side wall 20B and the lower wall 20C of the upper cover 20. The engagement hook 76 of the upper cover 20 fits into the engagement groove 70A in the lower cover 22, and the engagement wall 70 of the lower cover 22 fits into the engagement recess 76A in the upper cover 20.

Explanation follows regarding operation of the present exemplary embodiment. In the buckle device 10 structured as above, when the insertion part 16A of the tongue plate 16 is inserted into the buckle body 30 through the tongue insertion slot 14 at the upper end of the cover 12, the press face 40A of the ejector 40 is pressed downward by a leading end (lower end) of the insertion part 16A. The ejector 40 thus slides from the ejected position to the inserted position against urging force from the ejector spring 42.

When the ejector 40 reaches the inserted position, a state in which the obverse side face (upper cover 20 side face) of the ejector 40 and the engagement piece 44C of the lock plate 44 are opposed (faced) is released (canceled) In addition, the pair of arms 44B of the lock plate 44 are pressed downward by the ejector 40, whereby the lock plate 44 is rotated toward the reverse side (lower cover 22 side) so as to rotate from the disengaged position to the engaged position. The engagement piece 44C thus passes through the engagement hole 16B in the insertion part 16A and through the insertion hole 32A in the buckle body 30.

The lock plate 44 also receives urging force from the lock spring 52 via the holder 48 and the lock member 46. The lock plate 44 is rotated from the disengaged position to the engaged position as above against urging force from the lock spring 52. Accordingly, when the lock plate 44 reaches the engaged position, the abutting pieces 44D of the lock plate 44 and the abutting face 46C of the lock member 46 are released (canceled) from an abutting state, and urging force from the lock spring 52 causes the lock member 46 to swing from the unlock position to the lock position, whereby the lock face 46D of the lock member 46 is abutted by the obverse side faces of the abutting pieces 44D. This restrains rotation of the lock plate 44 from the engaged position to the disengaged position, and the tongue plate 16 is retained in a state anchored by the engagement piece 44C of the lock plate 44, whereby the buckle device 10 adopts a tongue plate 16 fitted state (anchored state), and the webbing 18 passed through the tongue plate 16 is fitted over the occupant.

In the tongue plate 16 fitted state of the buckle device 10, when the operation portion 50A of the release button 50 is press-operated downward, the pressed portion 46B of the lock member 46 is pressed toward the lower side by the pressing portion 50B of the release button 50, and the lock member 46 swings from the lock position to the unlock position against urging force from the lock spring 52.

Accordingly, the lock face 46D of the lock member 46 and the abutting pieces 44D of the lock plate 44 are released (canceled) from the abutting state, and the restraint on rotation of the lock plate 44 from the engaged position to the disengaged position due to the lock member 46 is released (canceled) In addition, since urging force from the ejector spring 42 acts on the engagement piece 44C of the lock plate 44 via the ejector 40 and the insertion part 16A of the tongue plate 16, a component force acts on the obverse side (upper cover 20 side) of the engagement piece 44C. Accordingly, the lock plate 44 is rotated from the engaged position to the disengaged position as a result of the component force acting on the engagement piece 44C, and the anchoring of the tongue plate 16 by the engagement piece 44C is released (canceled) Thus, when the ejector 40 slides upward from the inserted position due to urging force from the ejector spring 42 and reaches the ejected position, the insertion part 16A of the tongue plate 16 in the buckle body 30 is released from the tongue insertion slot 14 at the upper end of the cover 12 by the sliding of the ejector 40, whereby the buckle device 10 adopts a tongue plate 16 not-fitted state (non-anchored state), and fitting of the webbing 18 passed through the tongue plate 16 over the occupant is disengaged.

In the buckle switch 54, the slide member 60 is pressed downward by the engagement recess 40B of the ejector 40 such that the slide member 60 slides from the ejected position to the inserted position. When the ejector 40 slides so as to be disposed in the ejected position, the slide member 60 of the buckle switch 54 slides upward, sliding from the inserted position to the ejected position.

In the buckle switch 54, when the slide member 60 is in the ejected position, the combination of the plural electrically conductive patterns on the switch substrate 58 is set to the first combination of the plural electrically conductive patterns that are made electrical continuous to one another by the slide member 60. The controller of the vehicle thereby determines that the buckle device 10 is in the not-fitted state, and for example, in a case in which the buckle device 10 continues to be in the not-fitted state after the engine has been started, the controller causes a warning lamp (not shown in the drawings) to flash so as to prompt the occupant to place the buckle device 10 in the fitted state.

Further, in the buckle switch 54, when the slide member 60 is in the inserted position, the combination of the plural electrically conductive patterns on the switch substrate 58 is set to the second combination of the plural electrically conductive patterns that are made electrical continuous to one another by the slide member 60. The controller of the vehicle thereby determines that the buckle device 10 is in the fitted state, and for example after the engine has been started, the controller actuates a motor in a take-up device (not shown in the drawings) for the webbing 18 to adjust the tension in the webbing 18 to an appropriate value.

Note that in the cover 12 of the buckle device 10, the upper cover 20 is assembled to the lower cover 22. In this case, the engagement wall 70 of the side wall 22C on the left side of the lower cover 22 fits together with the engagement recess 76A on the inner face of the side wall 20B on the left side of the upper cover 20, and the engagement hook 76 of the side wall 20B on the left side of the upper cover 20 fits together with the engagement groove 70A in the side wall 22C on the left side of the lower cover 22. The side wall 20B on the left side of the upper cover 20 thus overlaps with the engagement wall 70 of the lower cover 22 in the left-right direction, and the upper cover 20 engages with the lower cover 22, whereby the upper cover 20 is restrained from coming away from the lower cover 22.

The buckle body 30 and the buckle switch 54 are disposed inside the lower cover 22, and the holder 56 of the buckle switch 54 is sandwiched (nipped) between the side plate 34 on the left side of the buckle body 30 and the engagement wall 70 of the lower cover 22 such that the holder 56 abuts the ribs 72 of the lower cover 22. Accordingly, when the side wall 20B on the left side of the upper cover 20, or the side wall 22C on the left side of the lower cover 22, receives an external force from the left side, an obverse side section of the ribs 72 of the engagement wall 70 presses the holder 56 toward the side plate 34 on the left side of the buckle body 30.

Due to the engagement wall 70 being thus abutted by the side plate 34 on the left side of the buckle body 30 via the holder 56, the rigidity of the side wall 20B and the side wall 22C on the left side is able to be increased by the buckle body 30 in a state in which the upper cover 20 is assembled to the lower cover 22. Consequently, the occurrence of deflection or flexure in the side wall 20B on the left side of the upper cover 20 and in the side wall 22C of the lower cover 22 is suppressed, enabling the engagement hook 76 to be restrained from coming away from the engagement groove 70A, and enabling the upper cover 20 to be suppressed from coming away from the lower cover 22. In addition, at the upper cover 20 side (obverse side) further than the engagement groove 70A, the ribs 72 press the holder 56, thus enabling external force received by the side wall 20B on the left side of the upper cover 20 to be reliably transmitted to the side plate 34 on the left side of the buckle body 30, and enabling the occurrence of deflection or flexure in the side wall 20B on the left side of the upper cover 20 to be suppressed.

Further, to increase the rigidity of the side wall 20B and the side wall 22C on the left side by using the buckle body 30, the holder 56 of the buckle switch 54 is disposed between the side plate 34 on the left side of the buckle body 30 and the engagement wall 70.

Accordingly, the position where the holder 56 is disposed in the lower cover 22 is able to be made nearer to the lower side of the lower cover 22. This enables the up-down direction length of the lower cover 22 (cover 12), internally provided with the sliding-contact type buckle switch 54, to be shortened, enabling the cover 12 to be made more compact.

Further, a lower side face of the projecting portion 66A of the holder 56 is abutted by the restricting wall 68 of the lower cover 22, and the lower side face of the protrusion 66B of the holder 56 is abutted by the rib 72C of the lower cover 22. Accordingly, when the harness 64 inserted into the holder 56 from the under the cover 12 is pulled downward from the cover 12, movement of the holder 56 is restrained by the restricting wall 68 and the ribs 72C. This enables displacing or shifting of the holder 56 to be restrained, and enables displacing or shifting of the switch substrate 58 and the slide member 60 structuring the sliding contacts so that the boss 62 of the slide member 60 comes away from the engagement recess 40B in the ejector 40 to be prevented. Consequently, even if the harness 64 has been pulled, the buckle switch 54 is able to appropriately detect whether or not the tongue plate 16 is in a state of being fitted to the buckle device 10.

Moreover, the rib 72A on the upper side of the engagement wall 70 is abutted by an end face of the upper plate 56A of the holder 56. Accordingly, in the holder 56, an opening in the upper plate 56A through which the switch substrate 58 leads out is made narrow. Even if foreign matter or the like enters from the tongue insertion slot 14 of the cover 12 and the entering foreign arrives at the upper plate 56A of the holder 56 via the disposition space 36, this enables the entrance of the foreign matter into the holder 56 to be restrained, and enables the occurrence of shorts or the like between wiring lines of the harness 64 to be prevented. In addition, even if the rib 72 side of the holder 56 is open, the entrance of foreign matter into the holder 56 is able to be restrained.

Further, narrowing the opening in the upper plate 56A of the holder 56 enables the entrance of dirt or the like into the holder 56 to be suppressed, and enables dirt or the like to be restrained from adhering to the terminals 64A inside the holder 56 and/or to solder or the like for fixing the terminals 64A. This enables malfunction (erroneous detection) of the buckle switch 54 caused by dust or the like that has entered into the holder 56 and become adhered to the terminals 64A, for example, or caused by such dust or the like that has become damp, to be suppressed.

Note that in the present exemplary embodiment described above, the engagement wall 70 of the lower cover 22 is overlapped with the side wall 20B of the upper cover 20 such that the engagement wall 70 is caused to enter (fit together with) the engagement recess 76A in the side wall 20B and the engagement hook 76 of the side wall 20B is caused to enter (fit together with) the engagement groove 70A to engage the upper cover 20 with the lower cover 22. However, in an engagement portion, at a section where a first covering member and a second covering member overlap, it is sufficient to provide an engagement protrusion to one of the first covering member and the second covering member and to provide an engagement recess to the other of the first covering member and the second covering member such that the first covering member and the second covering member are engaged so as to not come apart.

What is claimed is:

1. A buckle device comprising:

a covering body into which a tongue provided at a belt is configured to be inserted, the covering body being provided with an engagement portion at which a first covering member and a second covering member are engaged;

a rigid member that is provided inside the covering body, the belt being fitted on an occupant by the tongue, inserted into the covering body, being inserted into the rigid member;

a detection unit that is provided inside the covering body, a moving section being moved at a communicating member in accordance with the tongue being inserted into the rigid member, whereby the detection unit detects insertion of the tongue into the rigid member; and a housing body in which the communicating member is housed and contacted by, the housing body restraining movement of the engagement portion toward the rigid member due to the housing body being interposed between the engagement portion and the rigid member such that the housing body is abutted by the engagement portion and the rigid member.

2. The buckle device of claim 1, further comprising a restricting portion that is provided inside the covering body, the restricting portion restricting movement of the housing body in an insertion direction of the tongue by the restricting portion abutting the housing body.

3. The buckle device of claim 1, further comprising a closing portion that is provided at the engagement portion at a housing body side thereof, the closing portion closing a portion between the housing body and the engagement portion by the closing portion being abutted by one end side portion of the housing body in an insertion direction of the tongue.

4. The buckle device of claim 2, further comprising a closing portion that is provided at the engagement portion at a housing body side thereof, the closing portion closing a portion between the housing body and the engagement portion by the closing portion being abutted by one end side portion of the housing body in the insertion direction of the tongue.

5. The buckle device of claim 1, wherein the communicating member is fixed to the housing body.

* * * * *